United States Patent [19]

Heiser

[11] Patent Number: 4,614,992

[45] Date of Patent: Sep. 30, 1986

[54] ACTUATOR DRIVER WITH OPEN-CIRCUIT AND STRAY GROUND PROTECTION

[75] Inventor: Richard K. Heiser, Wayzata, Minn.

[73] Assignee: Sundstrand Corporation, Rockford, Ill.

[21] Appl. No.: 768,736

[22] Filed: Aug. 23, 1985

[51] Int. Cl.[4] ..... H01H 47/22

[52] U.S. Cl. ..... 361/160; 361/210

[58] Field of Search ..... 361/160, 210

[56] References Cited

U.S. PATENT DOCUMENTS

| | | | |
|---|---|---|---|
| 4,338,651 | 7/1982 | Henrich | 361/154 |
| 4,355,619 | 10/1982 | Wilkinson | 123/490 |
| 4,447,851 | 5/1984 | Simmons | 361/210 X |

*Primary Examiner*—Michael L. Gellner

*Attorney, Agent, or Firm*—Wood, Dalton, Phillips Mason & Rowe

[57] ABSTRACT

Actuators typically include one or more coils which are driven by a current source to effect positioning of a movable member. However, faults can occur wherein a conductor connecting the coil to the current source is open circuited or short circuited to ground. This can lead to a loss of control over the actuator, in turn creating a potentially dangerous condition. In order to overcome this problem, an actuator driver circuit according to the present invention includes a first current source for generating a first current at an output terminal thereof, a second current source for generating a second current at an output terminal thereof and first and second actuator coils connected in parallel between the output terminals of the first and second current sources. The current sources are controlled so that at least one of the current sources is capable of generating current for the coils even in the event of an open or short circuit fault condition.

17 Claims, 6 Drawing Figures

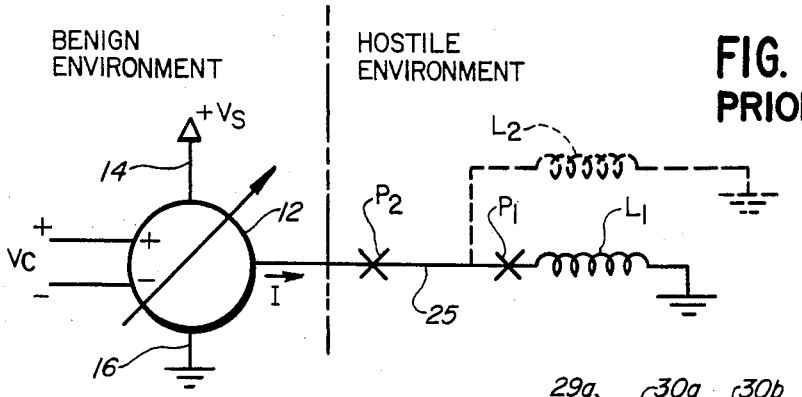
FIG. 1a
PRIOR ART
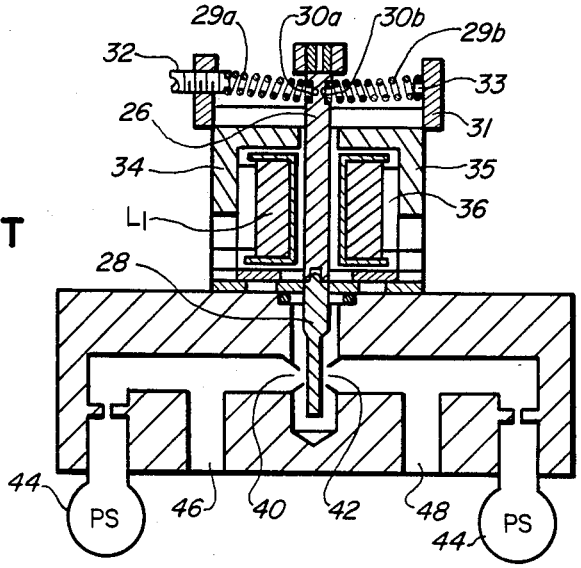
FIG. 1b
PRIOR ART
FIG. 2
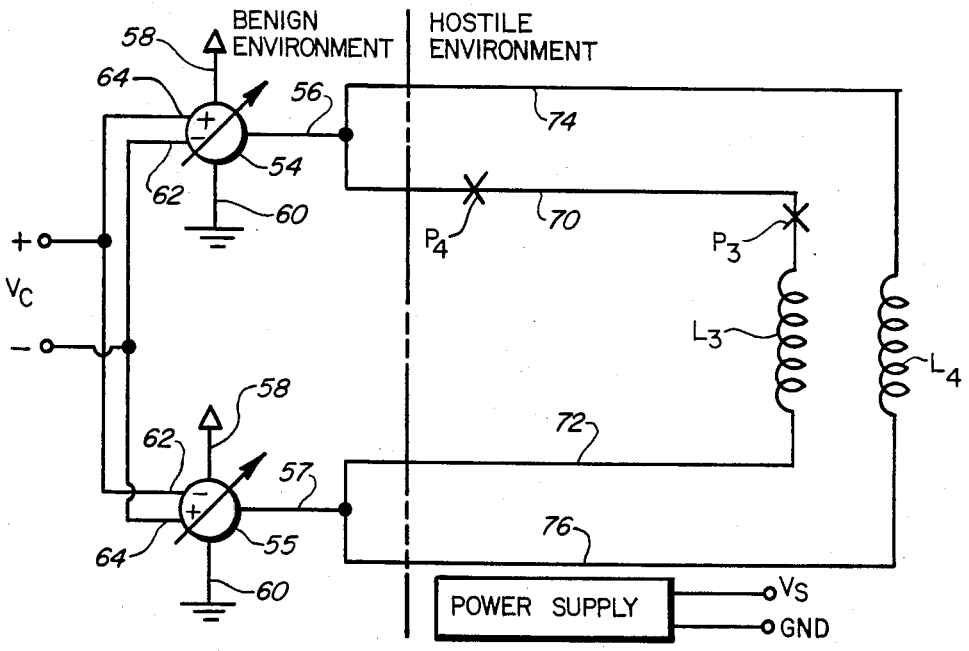

ACTUATOR DRIVER WITH OPEN-CIRCUIT AND STRAY GROUND PROTECTION

DESCRIPTION

1. Technical Field

The present invention relates to actuator controls, and more particularly to an electronic actuator driver having open-circuit and stray ground protection.

2. Background Art

Actuators have long been used to activate and control process equipment in response to a command signal. For example, a valve actuator causes a valve to open or close in response to a command, thereby controlling the flow of fluid through the valve.

An actuator typically includes a coil and a movable element, such as a plunger or a flapper in a valve. The coil is connected to an electrical power source and controls the position of the movable element in response to the current from the power source.

The direction of motion of the movable element depends upon the direction of the electromagnetic field established by the coil, which correspondingly is determined by the direction of the current traveling therethrough. Consequently, bidirectional motion of the movable element can be accomplished by utilizing a bidirectional power source. The power source is commonly referred to as a driver or more specifically as a valve driver, motor driver, etc.

This driver can be either a voltage source or a current source. The latter is generally preferred since it eliminates problems caused by changes in the resistance of the coil due to temperature effects and also helps overcome lags in response caused by the inductance of the actuator coil.

Actuators such as the above are often located in severe environments and are subjected to mechanical abuse. Such abuse can cause the coil and its connecting wires or conductors to be subject to fault conditions wherein the coil becomes either electrically disconnected from the power source (an open-circuit condition) or electrically coupled to ground (a ground condition). Such open-circuit or ground conditions render the actuator inoperative, thereby preventing continued control over the moveable element which in some instances can cause a potentially dangerous situation.

To lessen the impact such faults may have on the control of such actuators, a plurality of coils have been coupled in parallel via a single conductor to the current source. The coils are typically arranged so as to create an additive electromagnetic field which acts upon a single movable element.

By utilizing a plurality of parallel-connected coils, the loss of a single coil due to an open-circuit condition has no derogatory effect upon the operation of the actuator. However, if the power source has a ground reference, a ground condition occurring at any coil or along the conductor or an open-circuit condition occurring in the conductor will still render the actuator inoperative

SUMMARY OF THE INVENTION

In accordance with the present invention an actuator driver circuit includes a first current source for generating a first current at an output terminal thereof, a second current source for generating a second current at an output terminal thereof and first and second actuator coils connected in parallel between the output terminals of the first and second current sources. The current sources are controlled so that at least one of the current sources is capable of generating current for the coils even in the event of an open or short circuit fault condition.

More specifically, in a first embodiment, the power inputs to first and second current sources are coupled to a positive supply voltage $+V_S$ and to ground, respectively. The output terminal of the first current source is coupled via a first conductor to a first pair of actuator wires, one of which is coupled to a first end of a first coil and the other of which is coupled to a first end of a second, parallel coil. The output terminal of the second current source is also coupled via a second conductor to a second pair of actuator wires, one of which is coupled to a second end of the first coil and the other of which is coupled to the second end of the second coil.

Means are included to control the first and second current sources in accordance with a control voltage, such that the current generated by the first current source flows through both coils and into the second current source to control the position of the movable element.

In this embodiment of the invention, an open-circuit condition occurring at one of the coils or along one of the actuator wires supplying current to a coil will double the delivery of bidirectional current to the other coil, and hence full control over the actuator is maintained. In addition, a ground condition occurring at one of the coils or along one of the actuator wires coupled to one of the coils will not totally disable the actuator, since one of the current sources can still provide unidirectional current to the coils, and hence limited control is still possible.

In a second embodiment of the invention the power inputs to the current sources are coupled to a positive voltage supply, $+V_S$, and a negative voltage supply, $-V_S$. In this embodiment, an open-circuit or ground condition occurring at one of the coils or along one of the actuator wires coupled to one of the coils has no derogatory effect upon the operation of the actuator and full control thereover is maintained.

In a still further embodiment of the invention, an isolated power supply provides power to the current sources. This allows full control to be maintained over the actuator even in the event of an open-circuit or ground condition and is particularly useful in those applications where a double-ended power supply is not available.

BRIEF DESCRIPTION OF THE DRAWINGS

Other features and advantages of the invention will be apparent from the following description taken in connection with the drawings, wherein:

FIGS. 1*a* and 1*b* together comprise an electrical schematic diagram in conjunction with a sectional view of a prior art actuator and driver therefor;

FIG. 2 is a schematic diagram illustrating a first embodiment of the present invention;

BEST MODE FOR CARRYING OUT THE INVENTION

Figure 3:
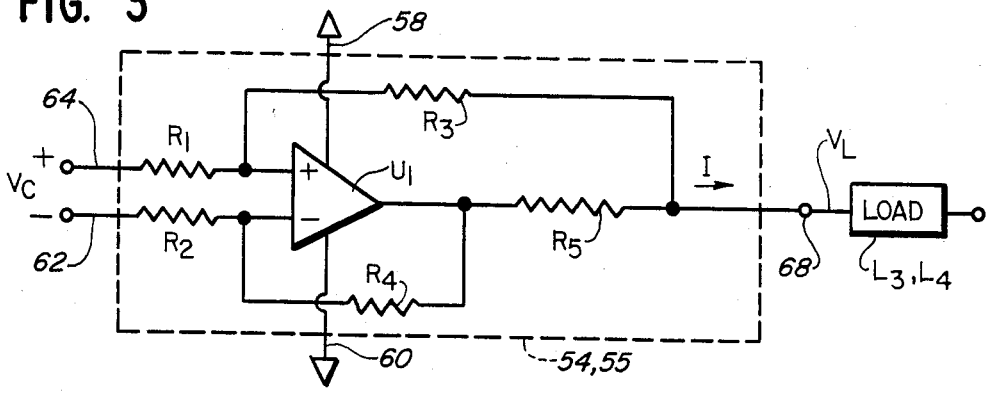
FIG. 3 is a schematic diagram illustrating a current source as utilized in the present invention.

Referring now to FIGS. 1*a* and 1*b*, there is illustrated a prior art actuator and driver therefor. The actuator is illustrated as an electromagnetically operated valve such as a pressure control pilot (PCP) valve as described in Sjolund U.S. Pat. No. 4,362,182, issued Dec. 7, 1982 and assigned to the assignee of the instant application. The actuator may, however, be of a different type as will be evident to those skilled in the art.

A valve driver in the form of a current source 12 is coupled to the first end of a coil $L_1$ by a conductor 25. The second end of the coil $L_1$ is coupled to ground. The first coil $L_1$ is typically located remotely from the current source 12 in a "hostile" environment as compared with the current source 12, which may be located in a "benign" environment. The words "hostile" and "benign" are intended to define environmental conditions according to the probability that such environment will give rise to a fault condition.

A positive supply voltage, $+V_s$, is applied to a first power input terminal 14 and a second input power terminal 16 is coupled to ground.

Referring specifically to FIG. 1*b*, the coil $L_1$surrounds a pivotally-mounted armature 26 which is secured to a flapper 28. The armature 26 and flapper 28 are spring-biased to a neutral or center position, in the absence of external forces, by null adjustment springs 29*a*,29*b* which extend between spring recesses 30*a*,30*b* on the armature 26 and portions of a spring holder plate 31. Specifically, the spring 29*a* extends between the recess 30*a* and an adjustment screw 32 secured within a threaded hole in the spring holder plate 31. The spring 29*b* extends between the recess 30*b* and a short stub 33 of the holder plate 31.

Pole pieces 34,35 are provided as are two permanent magnets, only one of which 36 is shown, for establishing a magnetic circuit.

The flapper 28 extends downwardly between nozzles 40,42 for controlling the pressures therein created by a pressure supply 44. Output ports 46,48 together provide an output differential pressure from the PCP valve.

Referring again to FIG. 1*a*, as current I generated by the current source 12 flows through the coil $L_1$to ground, an electromagnetic field is developed therein which acts upon the armature 26 and the flapper 28 causing same to pivot left or right, depending upon the direction of the current I, against the spring bias developed by the springs 29*a*,29*b*. This left or right movement changes the differential pressure from the output ports 46,48. The differential pressure is proportional to the current I.

Further detail on the operation of the illustrated PCP valve is contained in the above-noted Sjolund patent, the disclosure of which is hereby incorporated by reference.

As the first coil $L_1$ and associated wiring are often located remotely from the current source 12 and in a hostile environment, open-circuit and ground fault conditions affecting the flow of the current I through the first coil $L_1$ can occur. For example, an open-circuit or ground condition occurring at a first point $P_1$ would render the actuator inoperable, because the current I cannot flow through the first coil $L_1$ and thereby cannot establish the electromagnetic field.

To reduce the effect such fault conditions have on the operation of the actuator a second coil $L_2$ may be coupled in parallel with the first coil $L_1$ and disposed about the armature 26 to control the positioning thereof. Such a design allows for continued control over the actuator in the event of an open-circuit condition occurring at the first point $P_1$. However, this modification does not prevent loss of control in the event of a ground condition occurring at the first point $P_1$, or an open circuit or ground condition occurring at a second point $P_2$along the conductor 25.

Referring now to FIG. 2, there is illustrated a first embodiment of the present invention. First and second current sources 54,55, one form of which is described in greater detail below, are coupled by conductors 56,57, respectively, to first and second common ends of a pair of parallel connected actuator coils $L_3$ and $L_4$. The coils $L_3$ and $L_4$ may be disposed in the PCP valve shown in FIG. 1*b* about the armature 26. Each of the current sources includes power supply input terminals 58,60 and inverting and noninverting control inputs 62,64, respectively. The inverting and noninverting inputs 62,64 receive a control voltage $V_c$, described in greater detail below.

Referring now to FIG. 3, there is illustrated in greater detail a preferred form of each of the current sources 54,55 shown in FIG. 2. Each current source 54,55 includes an operational amplifier $U_1$, biasing resistors $R_1$–$R_5$, the first and second power input terminals 58,60 and control inputs 62,64 described above and an output terminal 68.

The current generated by each of the current sources 54,55, depends upon such variables as the voltages applied to the first and second power input terminals 58,60, the control voltage $V_c$ applied across the control input terminals 62,64, the resistance of the resistors $R_1$–$R_5$ and the load potential $V_L$ developed by the inductive load comprising the coils $L_3$ and $L_4$ and impressed on the output terminal 68.

In the preferred embodiment, $R_1=R_2=R_3=R_4$. Under such conditions, the current I developed by the current source 54,55 is equal to the control voltage $V_c$divided by the value of resistance $R_5$ ($I=V_c/R_5$). However, as explained in greater detail below, a current may not in fact be generated due to the voltage $V_L$ generated by the coils $L_3$,$L_4$.

Under normal operating conditions, i.e., where no fault has occurred, the current sources 54,55 are capable of supplying and or sinking bidirectional current flow so that the armature or other movable element (not shown) of the actuator can be driven in opposite directions. The direction of the current provided by the current sources 54,55 is in turn controlled by the polarity of the voltage $V_c$ applied to the inverting and noninverting inputs 62,64. In general, the current sources 54,55 are operated so that one of the current sources (for example, 54) operates as a controlled current source to provide current of a first polarity while the other (for example, 55) operates as a controlled current sink (or in other terms, as a current source of second polarity opposite the first polarity). The two current sources are controlled such that the currents are of equal magnitude and in corresponding direction through the actuator coils $L_3$,$L_4$.

In practice, it may not be possible to control the current sources 54,55 so that both conduct equal currents I. In such a case, one of the sources 54,55 will control the current conducted by the other.

During use of the actuator shown in FIG. 2, a fault condition may occur, for example, which is caused by a break in one of the actuator wires 70,72 or 74,76 which are in series with the coils $L_3$,$L_4$ and which connect same to the conductors 56,57. For example, at a point $P_3$, a break in the actuator wire 70 may occur, in turn disabling the coil $L_3$. In this case, full control over the actuator is maintained since full current I can still flow through the conductor 56, actuator wire 74, coil $L_4$, actuator wire 76, conductor 57 and current source 55. Of course, current flow may be in the opposite direction through the coil $L_4$ depending upon the polarity of the voltage $V_c$ applied to the input 62,64 of the current sources 54,55.

A second and potentially more severe fault may occur when one of the actuator wires 70–76 is grounded. For example, a ground connection may be established at a point $P_4$ in the actuator wire 70. In such a case, the current I developed by the current source 54 is shunted away from the coils $L_3$ and $L_4$ to ground, in turn effectively disabling this current source.

However, the current source 55 can still provide unidirectional current through the coils $L_3$ and $L_4$to the ground connection at the point $P_4$.

Referring again to the schematic diagram of FIG. 3, in the first embodiment the power supply input 58 is coupled to a positive voltage $+V_s$ while the power supply input 60 is coupled to ground potential. Hence, the current source 55 is capable of providing bidirectional current I, equal to the control voltage $V_c$ divided by the value of resistor $R_5$, providing that the output voltage at the load $V_L$ is anywhere between ground potential and voltage $V_s$.

If the load potential $V_L$ is equal to the positive voltage $+V_s$, the current source 55 is capable only of operating as a current sink, and therefore, may only provide current I in a clockwise direction. Conversely, if the load potential $V_L$ is at ground, the current source 55 is capable only of operating as a current supply, and therefore, may only provide current in a counterclockwise direction.

Since the voltage at the point $P_4$ is at ground potential and the voltage at the output 68 of the current source 55 is at some voltage above ground potential, current source 55 is capable of providing counterclockwise unidirectional current to afford limited control over the actuator.

Figure 4:
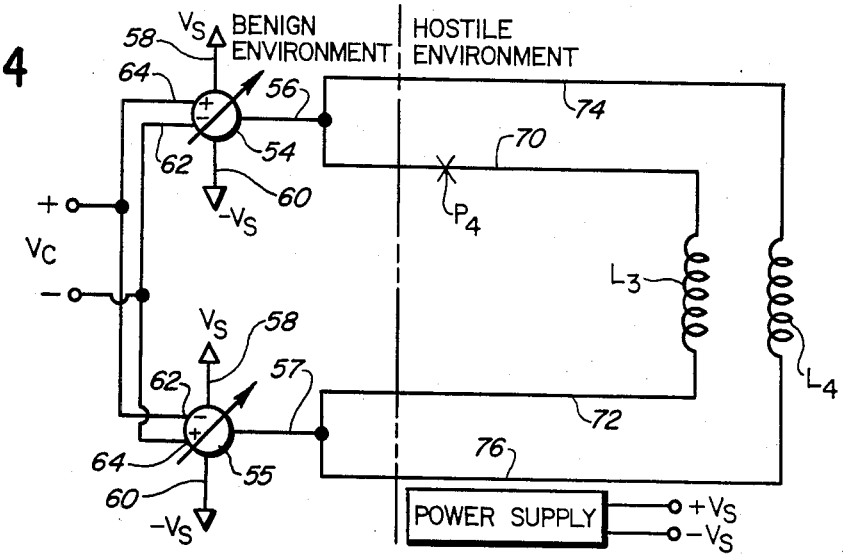
FIG. 4 is a schematic diagram illustrating a second embodiment of the present invention.

Referring now to FIG. 4, there is illustrated a second embodiment of the invention wherein like reference numerals refer to elements in common with FIG. 2. The embodiment shown in FIG. 4 differs from that shown in FIG. 2 only in that the voltages coupled to the power supply inputs 58,60 receive positive and negative voltages $V_s$ and $-V_s$ of equal magnitude and opposite sign. In this embodiment, full control is maintained over the actuator even in the event of a ground condition of one of the actuator wires 70–76. This is due to the fact that, for example, if a ground occurs at the point $P_4$, the current source 55 is capable of providing not only current in the counterclockwise direction as seen in FIG. 4, but also current in the clockwise direction. This ability greatly increases the failsafe ability of the actuator and driver of the present invention as compared with that illustrated in FIG. 2 since full control is not diminished, even in the event of a ground fault.

Figure 5:
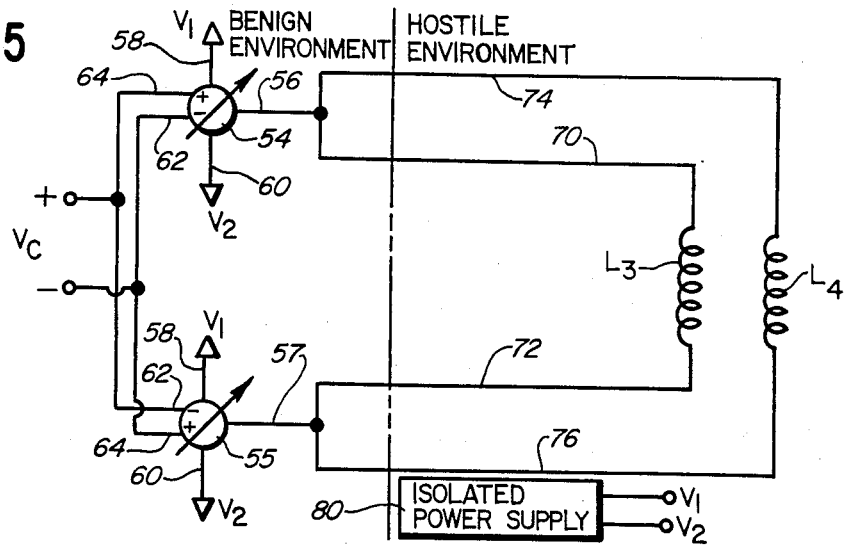
FIG. 5 is a schematic diagram illustrating a modification to the second embodiment of the present invention.

Referring now to FIG. 5, there is shown a modification of the embodiment shown in FIG. 4 wherein an isolated power supply 80 is used to provide power to the current sources 54,55. This modification is particularly useful in those applications wherein a double ended power supply is not provided, such as in an aircraft application.

In this case, the isolated power supply 80 develops isolated voltages $V_1$ and $V_2$ which are coupled to the power supply inputs of the current sources 54,55. This embodiment has the same capabilities to provide bidirectional current even in the event of an open or grounded fault condition similar to the embodiment shown in FIG. 4.

It should be noted in connection with any of the embodiments illustrated in FIGS. 2, 4 or 5, that the conductors 56,57 may be relatively short in length so that only the actuator wires 70–76 are located in the hostile environment which may be subject to abuse, fatigue or any other circumstances which give rise to a fault condition. This minimizes the possibility that a fault will occur in the conductors 56,57 and increases the probability that, should a fault occur, it will occur in the actuator wires 70–76 where the fault will not lead to a loss of control.

In addition, some faults could occur in an individual current source which would leave the circuit operable. One example would be a failure of a resistor $R_1$–$R_4$ shown in FIG. 3. Since the remaining current source is still operable, control over the actuator can be maintained.

I claim:

1. An actuator driver circuit for controlling an actuator having a pair of parallel connected coils, comprising:

a first current source for generating a first current of a first polarity at an output terminal thereof;

the parallel connected coils including first and second common ends, the first common end being connected to the output terminal of the first current source; and a second current source for generating a second current of a second polarity opposite the first polarity at an output terminal thereof, the second common end of the parallel connected coils being connected to the output terminal of the second current source such that the currents generated by the first and second current sources flow in the same direction through the parallel connected coils.

2. The driver circuit of claim 1, wherein each current source comprises an operational amplifier which receives first and second power supply input voltages.

3. The driver circuit of claim 2, wherein the first and second power supply voltages define a range of voltages includes ground potential.

4. The driver circuit of claim 2, further including an isolated power supply for developing the first and second power supply voltages.

5. The driver circuit of claim 2, further including a power supply for developing the first and second power supply voltages wherein the first power supply voltage is a non-ground potential and the second power supply voltage is at ground potential.

6. The driver circuit of claim 2, further including a power supply for developing the first and second power supply voltages wherein the power supply voltages are of opposite sign and equal magnitude.

7. An actuator driver circuit for controlling an actuator having a pair of parallel connected coils, comprising:

a first current source for generating a first current at an output terminal thereof;

a second current source for generating a second current at an output terminal thereof;

the parallel connected coils including first and second common ends separately connected to the output terminals of the first and second current sources, respectively; and means for providing first and second different power supply voltages to the first and second current sources, the first and second power supply voltages defining a range of voltages which includes ground potential, whereby at least one of the current sources is capable of generating current for the coils even in the event of a fault condition.

8. The circuit of claim 7, wherein the first power supply voltage is a non-ground potential and the second power supply voltage is at ground potential.

9. The circuit of claim 8, wherein the first and second current sources each include an operational amplifier.

10. The circuit of claim 8, wherein the direction of the current generated by each current source is controlled by a control voltage.

11. The circuit of claim 7, wherein the first power supply voltage is a positive potential and the second power supply voltage is a negative potential.

12. The circuit of claim 11, wherein the first and second power supply voltages are of equal magnitude.

13. The circuit of claim 12, wherein the first and second current sources each include an operational amplifier.

14. The circuit of claim 12, wherein the direction of the current generated by each current source is controlled by a control voltage.

15. An actuator driver circuit for controlling an actuator having a pair of parallel connected coils, comprising:

a first current source for generating a first current at an output terminal thereof;

a second current source for generating a second current at an output terminal thereof;

the parallel connected coils including first and second common ends separately connected to the output terminals of the first and second current sources, respectively; and means for providing first and second different isolated voltages to the first and second current sources whereby at least one of the current sources is capable of generating current for the coils even in the event of a fault condition.

16. The driver circuit of claim 15, wherein each of the first and second current sources includes an operational amplifier which receives the isolated voltages.

17. The driver circuit of claim 16, wherein the direction of current generated by each current source is controlled by a control voltage coupled to control inputs of the operational amplifier.

* * * * *